United States Patent [19]

Eller

[11] Patent Number: 4,754,726

[45] Date of Patent: Jul. 5, 1988

[54] EMISSION CONTROL APPARATUS

[76] Inventor: Trevor L. Eller, "Lake View", R.M.B. 2007, Pomonal Road, Stawell, Victoria, Australia

[21] Appl. No.: 880,248

[22] Filed: Jun. 30, 1986

[30] Foreign Application Priority Data

Dec. 21, 1983 [AU] Australia ..... PG2936

[51] Int. Cl.[4] ..... F02M 25/02

[52] U.S. Cl. ..... 123/25 E; 123/536

[58] Field of Search ..... 123/572, 573, 536, 537, 123/538, 1 A, 25 E, 25 A, 3, DIG. 12; 320/15

[56] References Cited

U.S. PATENT DOCUMENTS

| | | | |
|---|---|---|---|
| 1,876,879 | 9/1932 | Drabold | 123/536 |
| 2,184,141 | 12/1939 | Dodge | 123/573 |
| 3,648,668 | 3/1972 | Pacheco | 123/536 |
| 3,844,262 | 10/1974 | Dieges | 123/572 |
| 4,053,683 | 10/1977 | Rounds | 123/536 |
| 4,090,122 | 5/1978 | Hoinski | 320/15 |
| 4,414,924 | 11/1983 | Harren | 123/573 |

FOREIGN PATENT DOCUMENTS

| | | | |
|---|---|---|---|
| 0133464 | 8/1983 | Japan | 123/DIG. 12 |
| WO85/02885 | 7/1985 | PCT Int'l Appl. | 123/537 |

*Primary Examiner*—Willis R. Wolfe, Jr.
*Assistant Examiner*—M. Macy
*Attorney, Agent, or Firm*—Pollock, VandeSande & Priddy

[57] ABSTRACT

Apparatus to reduce exhaust pollution of internal combustion engines (12) comprises a manifold (26) connected to the cells of the battery (23) of the electrical system associated with the engine (12), the manifold (26) receiving gas/vapor emitted from the battery cells. The manifold (26) is connected by a line (27) to the fuel/air inlet manifold (14) of the engine (12), preferably via the gas recirculation line (22) connecting the crankcase ventilation to the inlet (14). Water vapor taken from the engine radiator (31) can also be drawn into the line (27) through an accumulator (28). A second battery (34) can also be connected to the accumulator (28) to increase the gas/vapor drawn into the inlet (14).

5 Claims, 2 Drawing Sheets

36
34
35

33
32
25
24
26
24
27
23
28
31
27
29
22
17
21
37
16
19
22
14
12
42
41
18
40
39
38

EMISSION CONTROL APPARATUS

BACKGROUND OF THE INVENTION

This invention relates to emission control apparatus and relates particularly to such apparatus for use on internal combustion engines such as petrol, gas or diesel engines in vehicles or in other installations.

The invention relates more particularly to apparatus for use in association with the fuel supply to the engine whereby the normal fuel of petrol, gas, diesel or the like is caused to burn more efficiently within the cylinder or combustion chamber of the engine. Such increase in burning efficiency results in a reduction of exhaust pollutants as well as increasing operating efficiencies.

BACKGROUND ART

Heretofore, emission control devices have been proposed to control the emission of pollutants from the exhaust of internal combustion engines. Such devices include equipment to circulate crankcase ventilation gases through the engine, devices to produce a clean burning of the fuel to reduce pollutants, catalytic converters to reduce exhaust gas pollutants, and the like. Such devices are either only partially successful in reducing emission pollutants or are relatively complicated and tend to reduce the efficiency of the engine.

It is therefore desirable to provide improved apparatus for controlling the emission of pollutants from internal combustion engines which effectively reduces such pollutants and does not detract from the efficiency of the engine.

It is also desirable to provide pollution control apparatus which may be adapted for any internal combustion engine.

It is also desirable to provide pollution control equipment which increases the efficiency of the internal combustion engine to which the apparatus is fitted.

SUMMARY OF INVENTION

According to one aspect of the invention there is provided pollution control equipment for use with an internal combustion engine which operates in conjunction with a lead-acid battery comprising manifold means mounted on the battery and receiving gas/-vapour emitted from the battery cells, said manifold means being connected to the fuel/air inlet of the internal combustion engine.

In one form of the invention, the manifold means comprises risers mounted on the vents of each cell of the lead-acid battery, the risers being connected together and to the inlet manifold of the engine.

In another form of the invention for use particularly with water-cooled internal combustion engines, a vent taken from the water overflow outlet of a cooling radiator communicates with the line between the manifold means and the internal combustion engine so that water vapor from the overflow outlet also passes to the fuel-/air inlet of the engine. Preferably, the overflow outlet communicates with a sealed vessel through which passes the line connecting the manifold means to the fuel/air inlet of the engine, the line passing through the vessel having an inlet hole through which water vapour can enter the line.

It is believed that the apparatus of the invention operates by utilizing gases, which are normally vented from the lead-acid battery to atmosphere, as a fuel or fuel additive or modifier which causes the normal fuel to burn relatively cleanly and efficiently. This also results in a reduction in the use of the petrol, diesel or gas fuel normally used by the engine, which is an unexpected advantage of the present invention.

It has been found that the apparatus of the invention substantially reduces pollutant emission from the engine exhaust without any reduction in power output or flexibility of the engine. In some instances, the power output and flexibility of the engine is improved with the apparatus of the invention.

In order that the invention is more readily understood two embodiments thereof will now be described with reference to the accompanying drawings.

DESCRIPTION OF THE PREFERRED EMBODIMENTS

Figure 1:
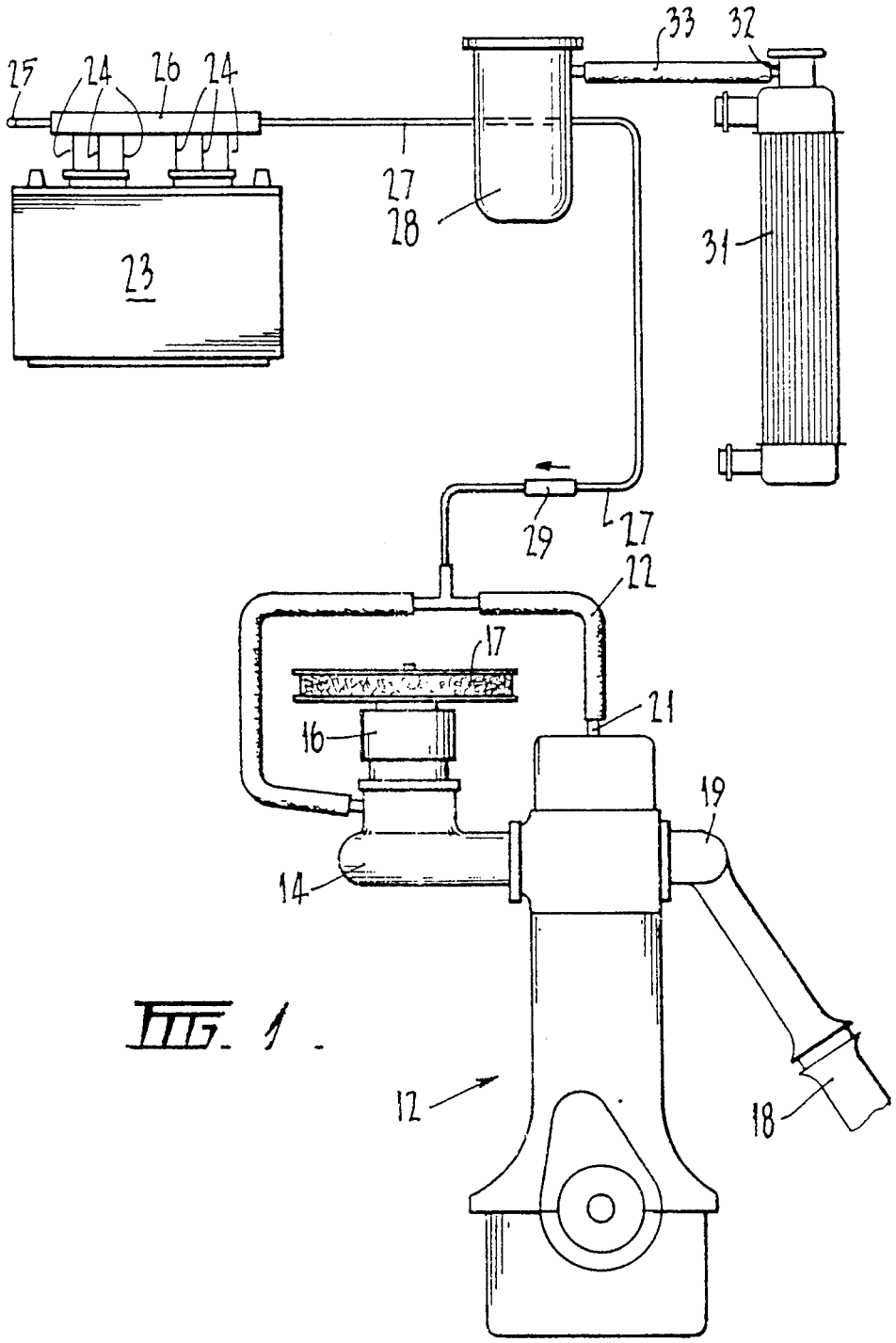
FIG. 1 is a schematic diagram of a first embodiment of the invention as fitted to a water-cooled internal combustion engine.

Referring to FIG. 1 of the drawings, an internal combustion engine 12 has an inlet manifold 14 on which is mounted a carburettor 16 having a normal air cleaner 17. An exhaust pipe 18 is connected to the exhaust manifold 19. Gases which build up in the engine crankcase pass through a plenum ventilation crankcase valve 21 to the inlet manifold 14 through the gas recirculation line 22 to recirculate such gases through the engine and thus avoid atmospheric pollution.

It will be appreciated that the particular arrangement of internal combustion engine will vary in accordance with variations in the design of engine to which the apparatus of the invention is fitted.

A lead-acid battery 23, which is used in conjunction with the engine 12 and is connected to appropriate electrical circuits, including a charging circuit (not shown) is provided with risers 24 extending from the batterycells, such as from the cell vents. The risers 24 are connected together by an appropriate manifold 26 one end 25 of which is open to atmosphere. The other end of the manifold 26 is connected by a line 27 into the crankcase gas recirculation line 22 via a condensation accumulator 28 and a one way valve 29. The line 27 passes through the accumulator 28, which is a sealed vessel, the line 27 within the accumulator being provided with a hole (not shown) through which gas or vapour in the accumulator can be drawn into the line 27.

The one way valve 29 permits flow of gas or vapour in the line 27 in one direction only thus preventing gas pressure resulting from, for example, a high inlet manifold pressure or an engine backfire, pressurizing the accumulator 28 and the manifold 26.

A water radiator 31, which is used in conjunction with cooling water circulating around the engine 12, has its overflow outlet 32 connected by line 33 to the accumulator 28. Thus, water vapor from the overflow outlet is conveyed into the accumulator 28 from where it is drawn into the line 27 and passes into the inlet manifold 14 of the engine 12.

In use of this form of the apparatus, gases or vapour emitted from the lead-acid battery, resulting from the charging thereof through the electrical circuit associated with the engine, are drawn from the manifold 26 along the line 27, through the accumulator 28 and along line 22 into the inlet manifold 14 of the engine 12. Such gases are mixed with water vapour taken from the accumulator 28 and are passed into the combustion chambers of the engine 12 along with the fuel/air mixture passing through the carburettor 16. Such gases provide an adjunct to the normal fuel with the water vapour assisting in "softening" the detonation of fuel in the combustion chambers.

It will be appreciated that the line 27 may be connected directly to the inlet manifold 14 or into the venturi of the carburettor rather than into the crankcase gas recirculation line 22. Such an arrangement will then not be dependent on conditions in the line 22 which can vary due to variations in crankcase pressure and the like.

Use of the apparatus of the invention has been seen to result in engine oil remaining clean for relatively longer periods than normal as well as providing cleaner exhaust emissions. As previously indicated, embodiments of the invention have also provided an increase in engine power as well as flexibility due to improved torque characteristics. Engines to which the apparatus is fitted are also more easily started than normal.

Figure 2:
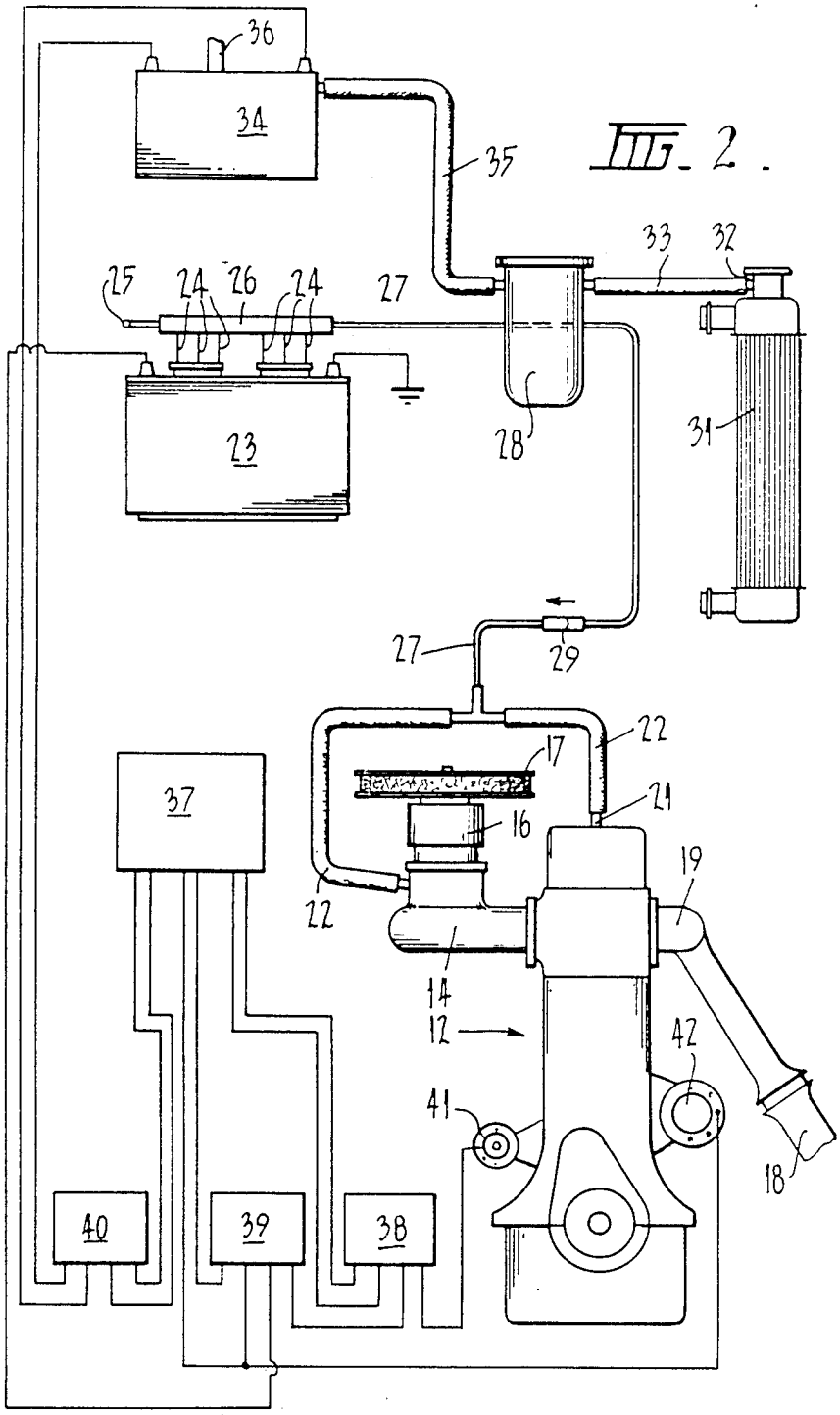
FIG. 2 is a schematic diagram of a second embodiment fitted to a water-cooled petrol engine.

Referring to FIG. 2 of the drawings, parts common to the embodiment of FIG. 1 have been given the same reference numeral for convenience.

In this embodiment, a separate battery 34 is connected by the line 35 to the accumulator 28. The battery 34 is also vented to atmosphere through line 36 to avoid any possibility of gas buildup in the battery 34.

The separate battery is preferably of a voltage less than that of the normal battery 23, and is connected to the alternator 42 in the electrical system associated with the engine so as to be charged thereby when the normal battery 23 is fully charged.

An electronic memory circuit 37 and three relays or electronic switches 38, 39 and 40, sense the charge on the battery 23 and switch the charging circuit to the battery 34 when the battery 23 has reached a predetermined charge level.

The relay 38, which receives a voltage from the ignition coil 41, provides a substantially constant voltage supply to the memory circuit 37.

The relay 39 is controlled by the memory circuit 37 to provide a charging current to the normal battery 23, subject to the charge level of that battery. When the charge level reaches a predetermined level, relay 40 switches the charging current to the auxiliary battery 34. If the charge level of the normal battery 23 drops below a predetermined level, the relay 40 switches the charging circuit back to the normal battery 23 through relay 39.

Therefore, in this embodiment, two batteries are associated with the engine so as to increase the volume of gas/vapour which can be drawn into the inlet manifold 14 and to enable the apparatus to operate even if the normal battery is undercharged or overcharged and is not generating hydrogen.

Many modifications may be made to the design and/or construction of the apparatus of the invention. For example, two or more batteries may be connected in parallel with the cell vents being connected to the line to the inlet side of the engine.

I claim:

1. Pollution control apparatus for an internal combustion engine which operates in association with a lead-acid battery connected to a battery charging circuit, said apparatus comprising manifold means on the battery to receive gas/vapor emitted by the battery cells, conduit means connecting the manifold means to the fuel/air inlet of the internal combustion engine, one-way valve means in the conduit means to permit flow of gas/vapor in one direction only, an accumulator chamber connected by tube means to a source of water vapor which comprises a part of the water cooling system for the engine, and said conduit means being connected to the accumulator chamber to receive water vapor therefrom to mix with the battery gas/vapor therein.

2. Apparatus according to claim 1 wherein the conduit means passes through the accumulator chamber, the conduit means having an opening therein to communicate with the chamber.

3. Apparatus as claimed in claim 1 characterised in that a second lead-acid battery is connected to the electrical system to be charged thereby, and a second manifold means on the second battery communicates with the line connecting the first manifold means to the fuel/air inlet.

4. Apparatus as claimed in claim 3 wherein said second manifold means is connected to the accumulator.

5. Apparatus as claimed in claim 3 or claim 4 wherein electrical means are provided in the electrical system so that charging current is supplied to the first battery until that battery reached a predetermined charge level whereat the charging current is then applied to the second battery while the voltage of the first battery is continuously monitored, the charging current being switched back to the first battery if the voltage thereof drops below a predetermined level.

* * * * *